US010315286B2

(12) United States Patent
Trojan et al.

(10) Patent No.: US 10,315,286 B2
(45) Date of Patent: Jun. 11, 2019

(54) CHEMICAL MECHANICAL PLANARIZATION CARRIER SYSTEM

(71) Applicant: Axus Technology, LLC, Chandler, AZ (US)

(72) Inventors: Daniel R. Trojan, Phoenix, AZ (US); Richard Ciszek, Phoenix, AZ (US); Clifford Daniel, Tempe, AZ (US)

(73) Assignee: AXUS TECHNOLOGI, LLC, Chandler, AZ (US)

( * ) Notice: Subject to any disclaimer, the term of this patent is extended or adjusted under 35 U.S.C. 154(b) by 174 days.

(21) Appl. No.: 15/616,339

(22) Filed: Jun. 7, 2017

(65) Prior Publication Data

US 2017/0355062 A1 Dec. 14, 2017

Related U.S. Application Data

(60) Provisional application No. 62/350,109, filed on Jun. 14, 2016.

(51) Int. Cl.

| | |
|---|---|
| ***B24B 49/10*** | (2006.01) |
| ***B24B 37/30*** | (2012.01) |
| ***B24B 37/005*** | (2012.01) |

(52) U.S. Cl.

CPC ..... *B24B 37/30* (2013.01); *B24B 37/005* (2013.01)

(58) Field of Classification Search

CPC ..... B24B 7/22

(Continued)

(56) References Cited

U.S. PATENT DOCUMENTS 6,147,001 A 11/2000 Kimura et al.
6,179,956 B1 1/2001 Nagahara et al.

(Continued)

FOREIGN PATENT DOCUMENTS

JP 097984 1/1997
JP 2009224702 10/2009

(Continued)

OTHER PUBLICATIONS

Byrne et al., "Development and Validation of a 200 mm Wafter-Scale Finite Element Model of Contact Pressure Distribution in Chemical Mechanical Polishing," Proc. IMechE, Aug. 17, 2010, p. 2287-2295, vol. 225 Part B, Advanced Manufacturing Science Research Centre, University College, Dublin, Republic of Ireland.

(Continued)

*Primary Examiner* — Robert Rose

(74) *Attorney, Agent, or Firm* — Schmeiser, Olsen & Watts LLP

(57) ABSTRACT

A system includes a CMP carrier that includes a resilient flexible membrane upon which a wafer is mounted, at least three ports for supplying air to the resilient flexible membrane to pneumatically pushing on the wafer through pressure applied throughout the surface area of the resilient flexible membrane to have more uniform pressure. Each port provides pressure to different components of the carrier to adjust pressure or vary pressure during processing of the wafer. Further, the system includes a processor and software program for implementing the CMP carrier with existing CMP machines. The software application converts the air pressure applied to the carrier into units that allow the CMP machine to receive expected data and operate in accordance with the existing commands.

18 Claims, 6 Drawing Sheets

(58) Field of Classification Search
USPC ..... 451/5, 287, 288, 398, 388
See application file for complete search history.

(56) References Cited

U.S. PATENT DOCUMENTS

| | | | | |
|---|---|---|---|---|
| 6,508,696 | B1 | 1/2003 | Kobayashi et al. | |
| 7,074,118 | B1 * | 7/2006 | Bottema | B24B 37/30 451/285 |
| 2002/0098777 | A1 | 7/2002 | Laursen et al. | |
| 2002/0142704 | A1 | 10/2002 | Hu et al. | |
| 2002/0177395 | A1 | 11/2002 | Han et al. | |
| 2003/0068889 | A1 | 4/2003 | Kamada | |
| 2005/0124269 | A1 | 6/2005 | Masunaga et al. | |
| 2005/0142995 | A1 * | 6/2005 | Perlov | B24B 37/30 451/402 |
| 2005/0215182 | A1 * | 9/2005 | Fuhriman | B24B 37/30 451/41 |
| 2006/0057947 | A1 | 3/2006 | Cho | |
| 2006/0105685 | A1 | 5/2006 | Kajiwara et al. | |
| 2008/0254720 | A1 | 10/2008 | Hashimoto et al. | |
| 2012/0309275 | A1 | 12/2012 | Son | |
| 2014/0174655 | A1 | 6/2014 | Grinberg et al. | |
| 2014/0227945 | A1 | 8/2014 | Lin et al. | |
| 2015/0214090 | A1 | 7/2015 | Jin et al. | |

FOREIGN PATENT DOCUMENTS

| | | |
|---|---|---|
| JP | 2011124303 | 6/2011 |
| KR | 20030059638 | 7/2003 |
| KR | 101105704 | 1/2012 |
| KR | 20120046458 | 5/2012 |
| KR | 20150073334 | 7/2015 |

OTHER PUBLICATIONS

Accretech, ChaMP: For 300 mm Wafers, web page for product, https://www.accretech.jp/english/product/semicon/cmp/cmp300.html, accessed on Jun. 7, 2017.

* cited by examiner

CHEMICAL MECHANICAL PLANARIZATION CARRIER SYSTEM

CROSS REFERENCE TO RELATED APPLICATION[S]

This application claims priority to U.S. Provisional Patent Application entitled "CHEMICAL MECHANICAL PLANARIZATION CARRIER SYSTEM," Ser. No. 62/350,109, filed Jun. 14, 2016, the disclosure of which is hereby incorporated entirely herein by reference.

BACKGROUND OF THE INVENTION

Technical Field

This invention relates generally to a chemical mechanical planarization ("CMP") carrier and more particularly to a retro fit CMP carrier system that utilizes pneumatic pressure applied to a flexible membrane on the CMP carrier to apply force to a wafer during planarization.

State of the Art

Chemical mechanical planarization or chemical mechanical polishing CMP is a process that can remove topography from silicon oxide, poly silicon and metal surfaces. CMP is the only technique that performs global planarization of the wafer.

CMP is a process of smoothing and planing surfaces with the combination of chemical and mechanical forces, a hybrid of chemical etching and free abrasive polishing. Mechanical grinding alone causes too much surface damage, while wet etching alone lacks in achieving good planarization. Most chemical reactions are isotropic and etch different crystal planes with different speed. CMP involves both effects at the same time.

A typical CMP machine consists of a rotating platen that is covered by a pad. The wafer is mounted upside down in a carrier on a backing film. The retaining ring keeps the wafer in the correct horizontal position. During planarization, both the platen and the carrier rotate. The carrier may also oscillate. During loading and unloading the wafer is kept in the carrier by vacuum.

During chemical mechanical polishing, pressure is applied by down force on the carrier, transferred to the carrier through the carrier axis and typically a gimbal mechanism. Additionally, gas pressure or back pressure may also be applied to the wafer. A slurry is supplied from above on the platen in order to supply both the chemical processing and abrasive grains to perform the mechanical planarization.

The use of axial loading and back pressure on conventional carriers result in uneven planarization and lack the control necessary to apply varying forces at locations of the wafer during planarization.

Accordingly, there is a need in the field of CMP carriers for an improved carrier that can be retrofitted onto existing CMP machines.

DISCLOSURE OF THE INVENTION

The present invention relates to a CMP carrier and system that includes a resilient flexible membrane upon which a wafer is mounted, at least three ports for pneumatically pushing on the wafer through air pressure applied throughout the surface area of the resilient flexible membrane to have more uniform pressure. Each port provides pressure to different components of the carrier to adjust pressure or vary pressure during processing of the wafer. Further, the system includes a processor and software program for implementing the CMP carrier with existing CMP machines. The software application converts the air pressure applied to the carrier into units that allow the CMP machine to receive expected data and operate in accordance with the existing commands.

Embodiments include a system useful in a CMP process, the system comprising: an existing CMP machine; a CMP carrier comprising a resilient flexible membrane upon which a wafer is mounted and at least three air ports, wherein the at least three ports provide pressure to at least the resilient flexible membrane, a de-chuck membrane and a retaining ring, wherein the CMP carrier is retrofitted onto the existing CMP machine; a CMP computer coupled to the existing CMP machine, wherein the CMP computer contains a standard software program for operating the existing CMP machine in a typical fashion for controlling a down force of the CMP carrier; and a computer operatively coupled between the CMP carrier and the CMP computer, the computer programmed with a software program to: receive from the CMP computer a signal indicating voltage proportional to a downforce setting determined by the CMP computer operating the standard software program; automatically read and covert the voltage signal from the CMP computer to a downforce pneumatic pressure setting; and automatically calculate a downforce voltage corresponding to the downforce pneumatic pressure setting and output the downforce voltage to a voltage to pressure converter, wherein the voltage to pressure converter outputs a downforce pneumatic pressure proportional to the downforce voltage to the flexible membrane of the CMP carrier to apply pressure to a wafer.

Another embodiment includes a system useful in a CMP process, the system comprising: an existing CMP machine; a CMP carrier comprising: a resilient flexible membrane upon which a wafer is mounted; a membrane port providing pressure to the resilient flexible membrane; an inner chamber port providing pressure to a de-chuck membrane; and a retaining ring port providing pressure to a retaining ring, wherein the CMP carrier is retrofitted onto the existing CMP machine; a CMP computer coupled to the existing CMP machine, wherein the CMP computer contains a standard software program for operating the existing CMP machine in a typical fashion for controlling a down force of the CMP carrier; and a computer operatively coupled between the CMP carrier and the CMP computer and programmed, the computer programmed with a software program to: receive from the CMP computer a signal indicating voltage proportional to a downforce setting determined by the CMP computer operating the standard software program; automatically read and covert the voltage signal from the CMP computer to a downforce pneumatic pressure setting; automatically calculate and output a downforce voltage corresponding to the downforce pneumatic pressure setting to a voltage to pressure converter; receive from the CMP computer a signal indicating voltage proportional to a backpressure setting determined by the CMP computer operating the standard software program; automatically read and covert the voltage signal from the CMP computer to a backpressure pneumatic pressure setting; automatically calculate and output a backpressure voltage corresponding to the backpressure pneumatic pressure setting to a voltage to pressure converter; receive from the CMP computer a signal indicating voltage proportional to a retaining ring pressure setting determined by the CMP computer operating the standard software program; automatically read and covert the voltage signal from the CMP computer to a retaining ring pneumatic pressure setting; and automatically calculate and output a retaining ring voltage corresponding to the retaining ring pneumatic pressure setting to a voltage to pressure converter, wherein during operation of the existing CMP machine the voltage to pressure converter outputs: proportional downforce pneumatic pressure to the flexible membrane of the CMP carrier through the membrane port to apply pressure to a wafer; proportional backpressure pneumatic pressure to the de-chuck membrane of the CMP carrier through the inner chamber port; and proportional retaining ring pneumatic pressure to the retaining ring of the CMP carrier through the retaining ring port.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

CMP machines generally have 1, 2, 3, or 4 platens, on which pads are mounted. This enables multi-step CMP processes to occur in a single tool. The wafer is brought from a cassette to a load station where it is temporarily attached to a wafer carrier or polishing head using vacuum to pick it up with the side of the wafer to be polished is facing down. During the polishing, the carrier comes down on one side of the pad and both the carrier and platen spin the same direction. This is a good way of creating a fairly uniform relative velocity between the wafer and the pad in a compact space. The CMP carrier of the present invention is capable of pre-compressing the pad and various degrees of radial control of downforce pressure for tailoring of removal rate across the wafer as needed. Slurry is sent onto the pad surface near the center of the pad in a controlled quantity. Through centrifugal force, it moves toward the wafer and then off the edge of the pad for disposal.

Embodiments of the present invention relate to a CMP carrier and system that includes a resilient flexible membrane upon which a wafer is mounted, at least three ports for supplying air to the resilient flexible membrane to pneumatically pushing on the wafer through pressure applied throughout the surface area of the resilient flexible membrane to have more uniform pressure. Each port provides pressure to different components of carrier to adjust pressure or vary pressure during processing of the wafer. Further, the system includes a processor and software program for implementing the CMP carrier with existing CMP machines. The software application converts the control signals associated with rigid carriers to appropriate air pressures for a resilient carrier, and conversely converse pressures applied to the carrier into units that allow the CMP machine to receive expected data and operate in accordance with the existing commands.

Figure 1:
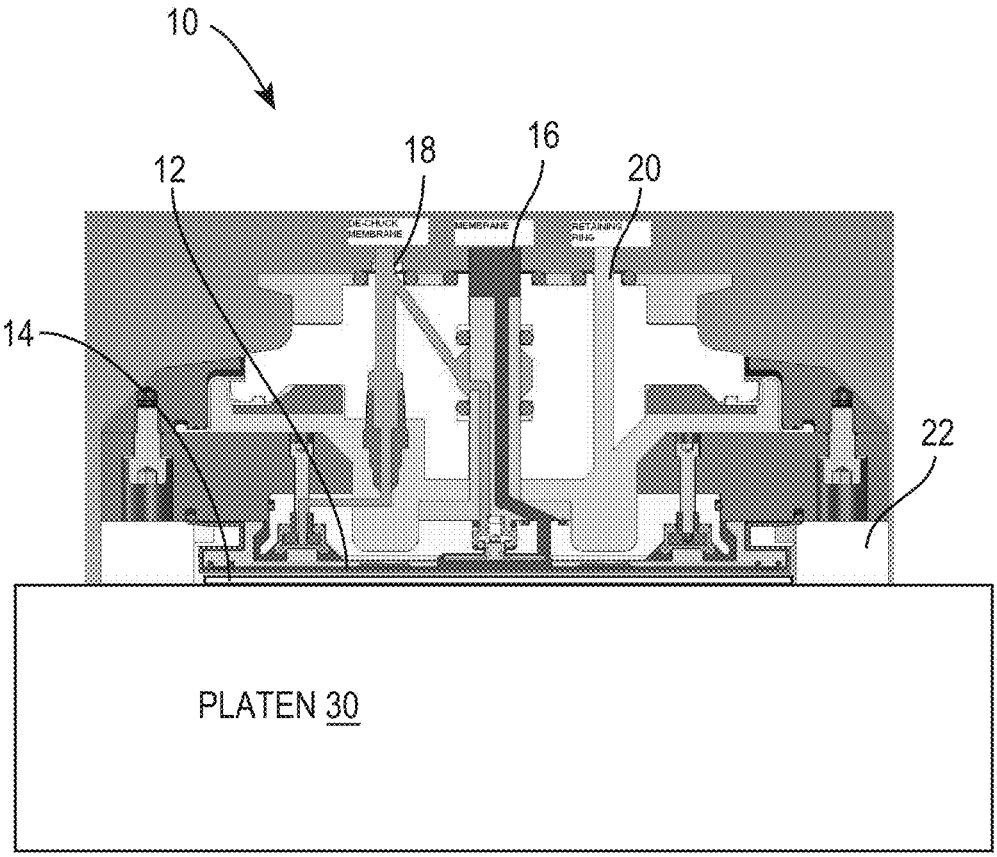
FIG. 1 is a diagrammatic view of a CMP carrier for retrofitting to an existing CMP machine with a retrofit CMP carrier system, in accordance with embodiments.

Referring to the drawings, FIG. 1 depicts a CMP carrier 10 in accordance with embodiments of the present invention. The carrier 10 includes a resilient flexible membrane 12 upon which a wafer 14 is mounted. The carrier 10 also includes at least three air ports; a membrane port 16, an inner chamber port 18 and a retaining ring port 20 for pneumatically pushing on the wafer in contact with a platen 30 by applying pneumatic pressure throughout the surface area of the resilient flexible membrane 12 to have more uniform pressure. Each port 16, 18 and 20 provides pressure to different components of the carrier 10. Membrane port 16 supplies air behind the flexible membrane 12 and therefore pressure to the entire flexible membrane 12. This pressure is applied uniformly to the entire back surface of the wafer, thus influencing the rate of material removal over the entire front surface of the wafer. Inner chamber port 18 supplies air to the de-chuck membrane and presses on the perforated plate to push it down against the back of the wafer 14. In one embodiment, a raised "cushion ring" attached to the perforated plate and positioned near the perimeter of the wafer will apply relatively higher pressure to the wafer perimeter, thus increasing the perimeter material removal rate relative to the interior area of the wafer. Retaining ring port 20 supplies air to the retaining ring and operates to supply pressure and presses the entire carrier down such that the bottom face of the retaining ring is pressed against the polishing pad, thus retaining the wafer in the head in the presence of shear force being applied to the wafer front surface, and also serves to pre-compress the polishing pad at the wafer edge to minimize pressure applied to the wafer edge during polishing. The air ports 16, 18 and 20 are independently operable in order to adjust pressure or vary pressure applied through each port 16, 18 and 20 during processing of the wafer 14. This ability to vary the pressure allows for more uniform planarization.

Figure 2:
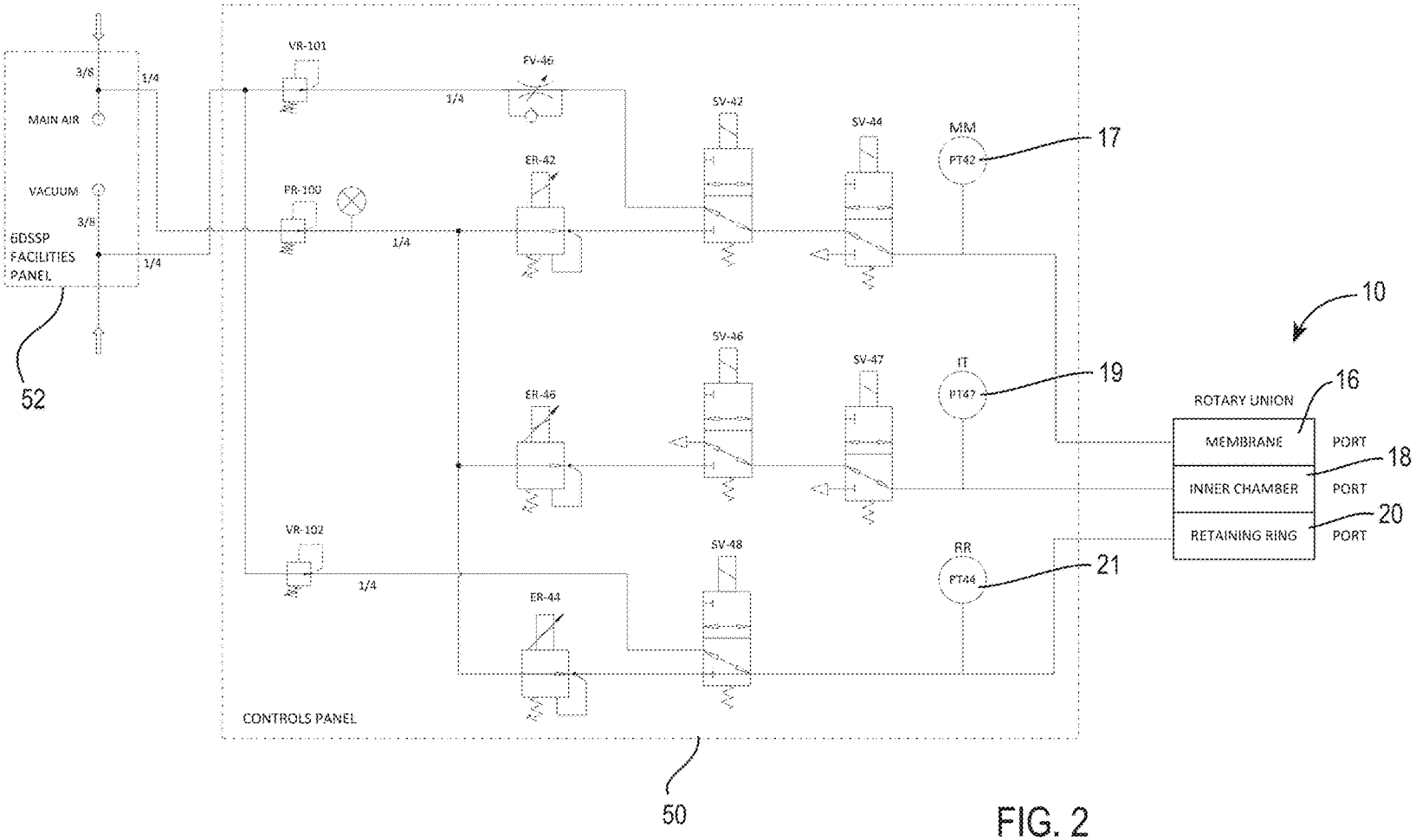
FIG. 2 is a schematic view of a retrofit CMP carrier system including a CMP carrier and a control system, in accordance with embodiments.

With additional reference to the drawing figures, FIG. 2 depicts a schematic of a CMP carrier 10 having air ports 16, 18, and 20, a control panel 50 for controlling air and vacuum through the ports 16, 18 and 20, and a facilities panel 52 wherein the facilities panel includes the main air source and the vacuum. The control panel operates to control how much air pressure is supplied to the ports 16, 18 and 20 during operation of the CMP carrier 10.

Figure 3:
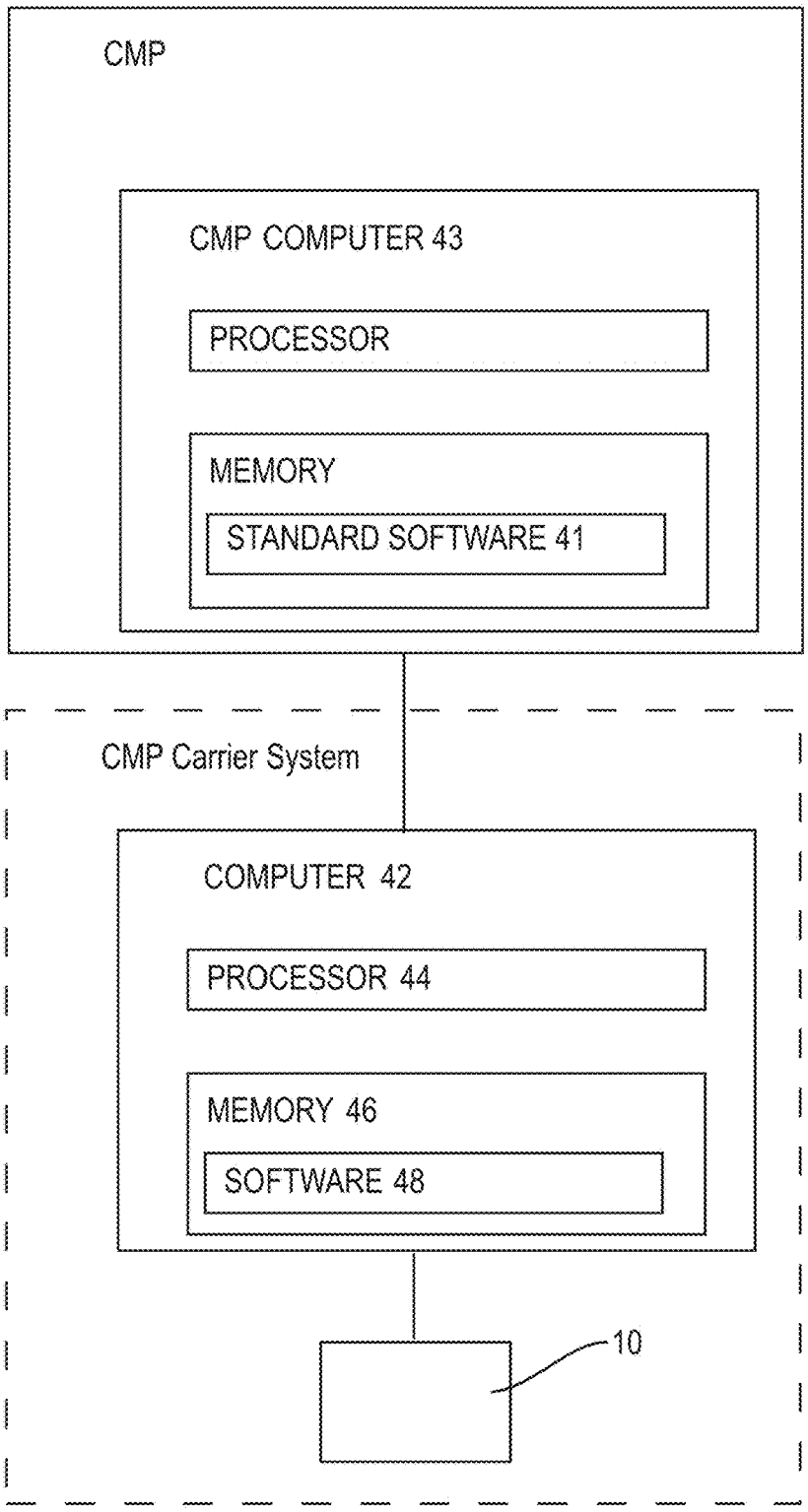
FIG. 3 is a diagrammatic view of a retrofit CMP carrier system retrofitted to an existing CMP machine, in accordance with embodiments.

Referring further to FIG. 3, the carrier 10 may be retrofitted onto an existing CMP machine 40. The mounting of the carrier 10 onto the existing CMP machine 40 utilizes the same connecting components. The carrier 10 may also be electrically coupled to a computer 42 electrically coupled to the existing CMP machine 40. The computer 42 comprises a processor 44, a memory 46 and a software program 48 installed on the computer 42 in disk space of the memory 46. The existing CMP machine 40 includes a CMP computer 43 includes a standard software program 41 installed on the CMP computer 43, wherein the standard software program 41 operates the existing CMP machine 40. The standard software program 41 operates to monitor the down force applied to a conventional carrier; however, it expects data from the carrier to be in a particular form. In order to retro fit the new CMP carrier 10 onto the existing CMP machine 40, software program 48 must be installed on the computer 42 in order to process the data collected from the new CMP carrier 10 providing data regarding the pressure of each port 16, 18 and 20 and converting it into data equivalent to data for down pressure of a conventional carrier in order to be processed by the CMP computer 43. Additionally, as the CMP computer 43 processing the instructions of the standard software program 41 requires adjustments to the down force of the carrier, The CMP computer 43 operating standard software program 41 sends data to computer 42 operating the software program 48 to receive and convert the data for down force of the carrier to the data required to adjust the pressure of the ports 16, 18 and 20

The functions and interactions of this system can be further explained based on the block diagram shown in FIGS. 4A-6B.

Figures 4A, 4B:
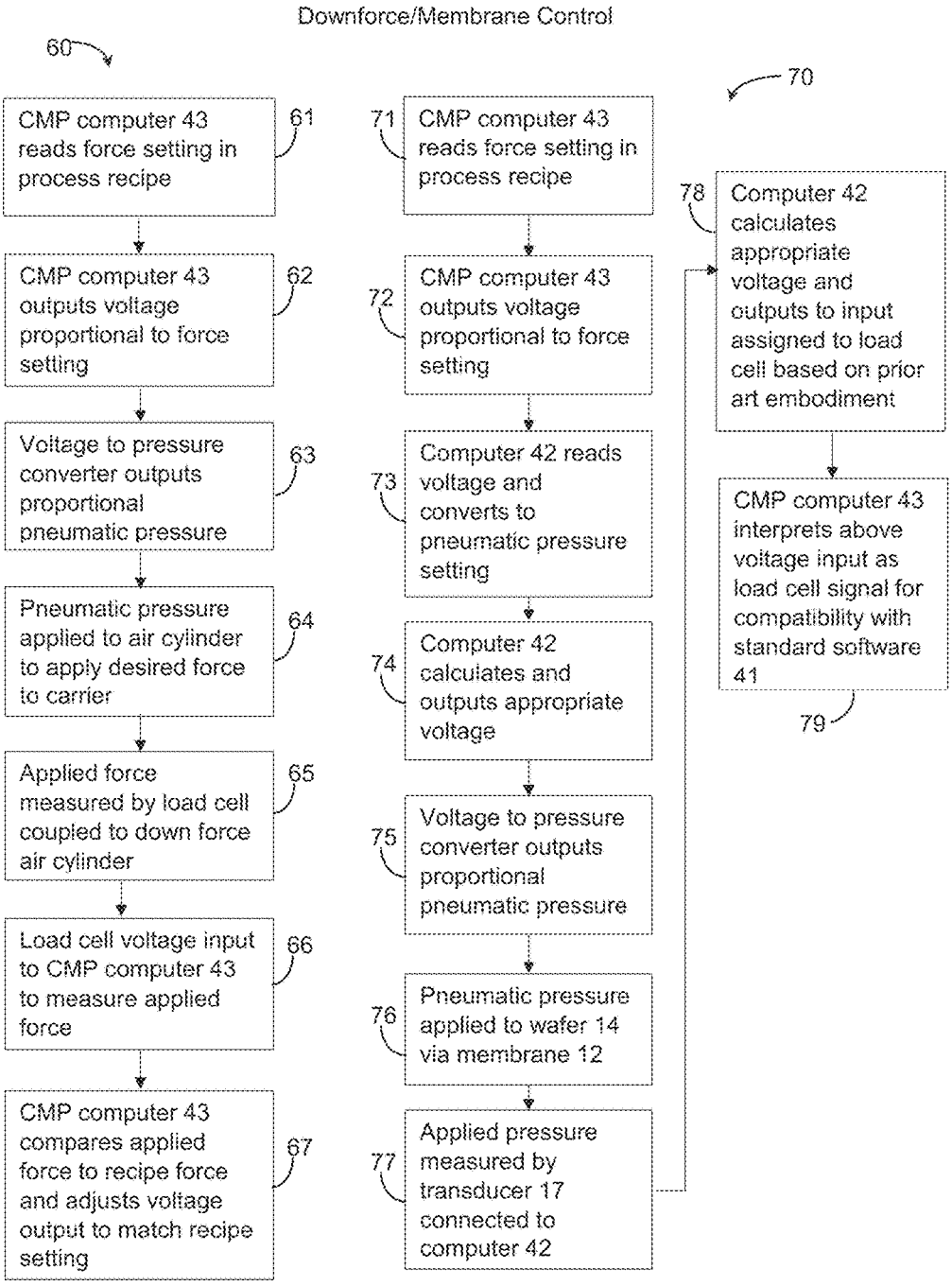
FIG. 4A (Prior Art)
FIG. 4A is a process for controlling downforce using a prior art system.
FIG. 4B is a process for membrane control using a retrofit CMP carrier system, in accordance with embodiments.

Referring to FIGS. 4A and 4B, embodiments of the system 10 operate for downforce/membrane control through the membrane port 16. As shown in FIG. 4A conventional prior art systems operate a process 60 to control the downforce. This prior art system process includes the CMP computer 43 reads the force setting in a process recipe (Step 61); the CMP computer 43 reads outputs voltage proportional to force setting (Step 62); voltage to pressure converter outputs proportional pneumatic pressure (Step 63); pneumatic pressure applied to air cylinder to apply desired force to carrier (Step 64); applied force measured by load cell coupled to down force air cylinder (Step 65); load cell voltage input to CMP computer 43 to measure applied force (Step 66); and CMP computer 43 compares applied force to recipe force and adjusts voltage output to match recipe setting (Step 67).

In comparison, FIG. 4B depicts an operation process 70 of a system 10 of an embodiment. The process 70 includes CMP computer 43 reads force setting in process recipe (Step 71); CMP computer 43 outputs voltage proportional to downforce setting (Step 72); computer 42 reads voltage and convers to a downforce pneumatic pressure setting (Step 73); computer 42 calculates the downforce pneumatic pressure and outputs a downforce voltage (Step 74); voltage to pressure converter outputs a downforce pneumatic pressure proportional to the downforce voltage (Step 75); downforce pneumatic pressure applied to wafer 14 via flexible membrane 12 (Step 76); applied downforce pressure measured by transducer 17 connected to computer 42 (Step 77); computer 42 calculates measured downforce voltage corresponding to the measured downforce pressure and outputs to an input assigned to a load cell of an existing CMP machine (Step 78); and computer 43 interprets the downforce voltage input as a load cell signal for compatibility with standard software 41 (Step 79).

Figures 5A, 5B:
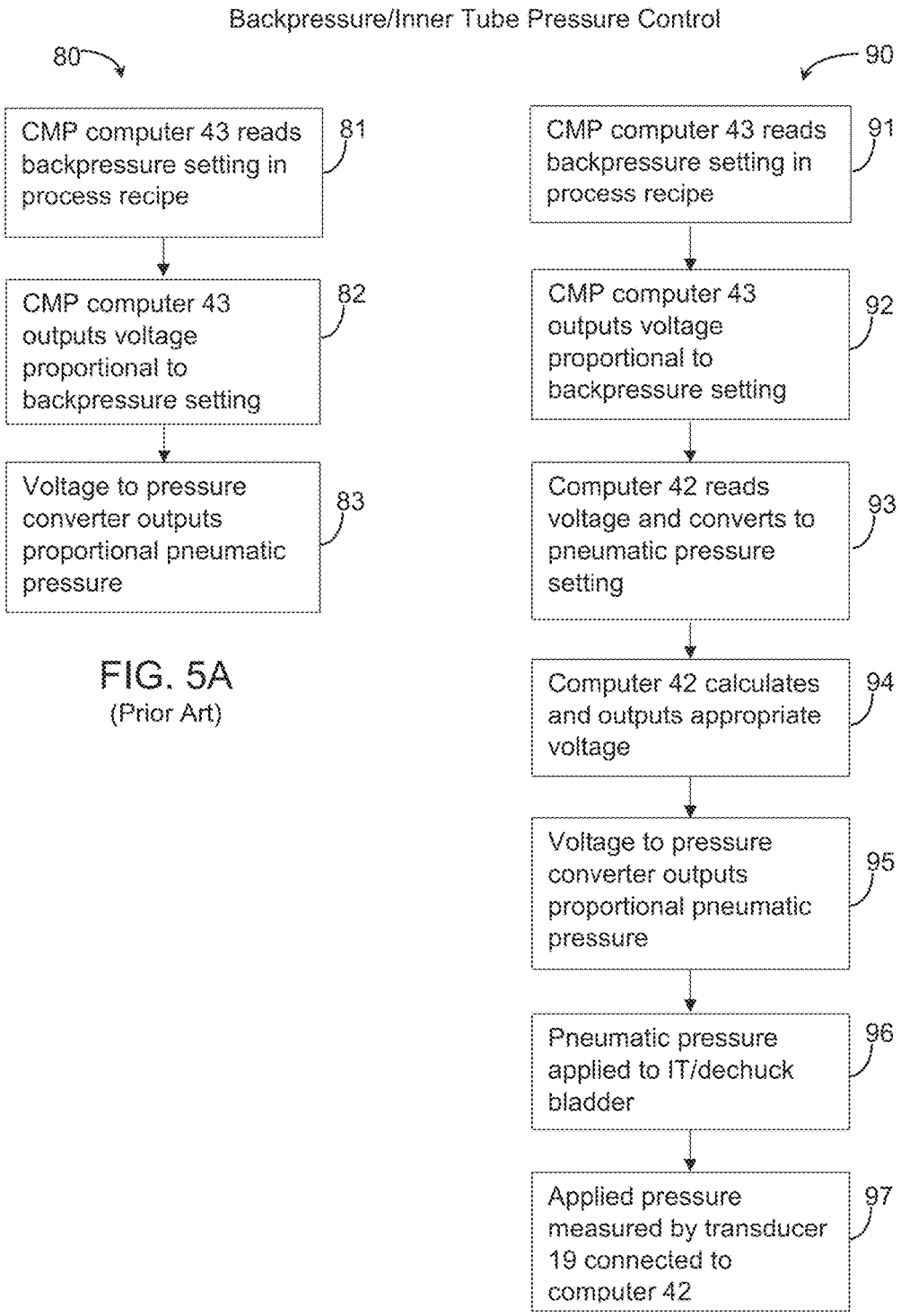
FIG. 5A (Prior Art)
FIG. 5A is a process for controlling backpressure using a prior art system.
FIG. 5B is a process for inner tube pressure control using a retrofit CMP carrier system, in accordance with embodiments.

Referring to FIGS. 5A and 5B, embodiments of the system 10 operate for backpressure/inner tube pressure control through the inner chamber port 18. As shown in FIG. 5A, operation process 80 of a prior art system includes CMP computer 43 reads backpressure setting in process recipe (Step 81); CMP computer 43 reads outputs voltage proportional to backpressure setting (Step 82); and voltage to pressure converter outputs proportional pneumatic pressure (Step 83).

In comparison, FIG. 5B depicts and operation process 90 of a system 10 of an embodiment. The process 90 includes CMP computer 43 reads backpressure setting in process recipe (Step 91); CMP computer 43 outputs voltage proportional to backpressure setting (Step 92); computer 42 reads voltage and converts to backpressure pneumatic pressure setting (Step 93); computer 42 calculates and outputs a backpressure voltage corresponding to the backpressure pneumatic pressure setting (Step 94); voltage to pressure converter outputs a backpressure pneumatic pressure proportional to the backpressure voltage (Step 95); backpressure pneumatic pressure is applied to IT/dechucker bladder or membrane (Step 96); and applied backpressure measured by transducer 19 connected to computer 42 (Step 97). The method 90 may further include computer 42 calculates measured backpressure voltage corresponding to the measured backpressure and outputs to an input assigned to a load cell of an existing CMP machine; and computer 43 interprets the backpressure voltage input as a load cell signal for compatibility with standard software 41.

Figures 6A, 6B:
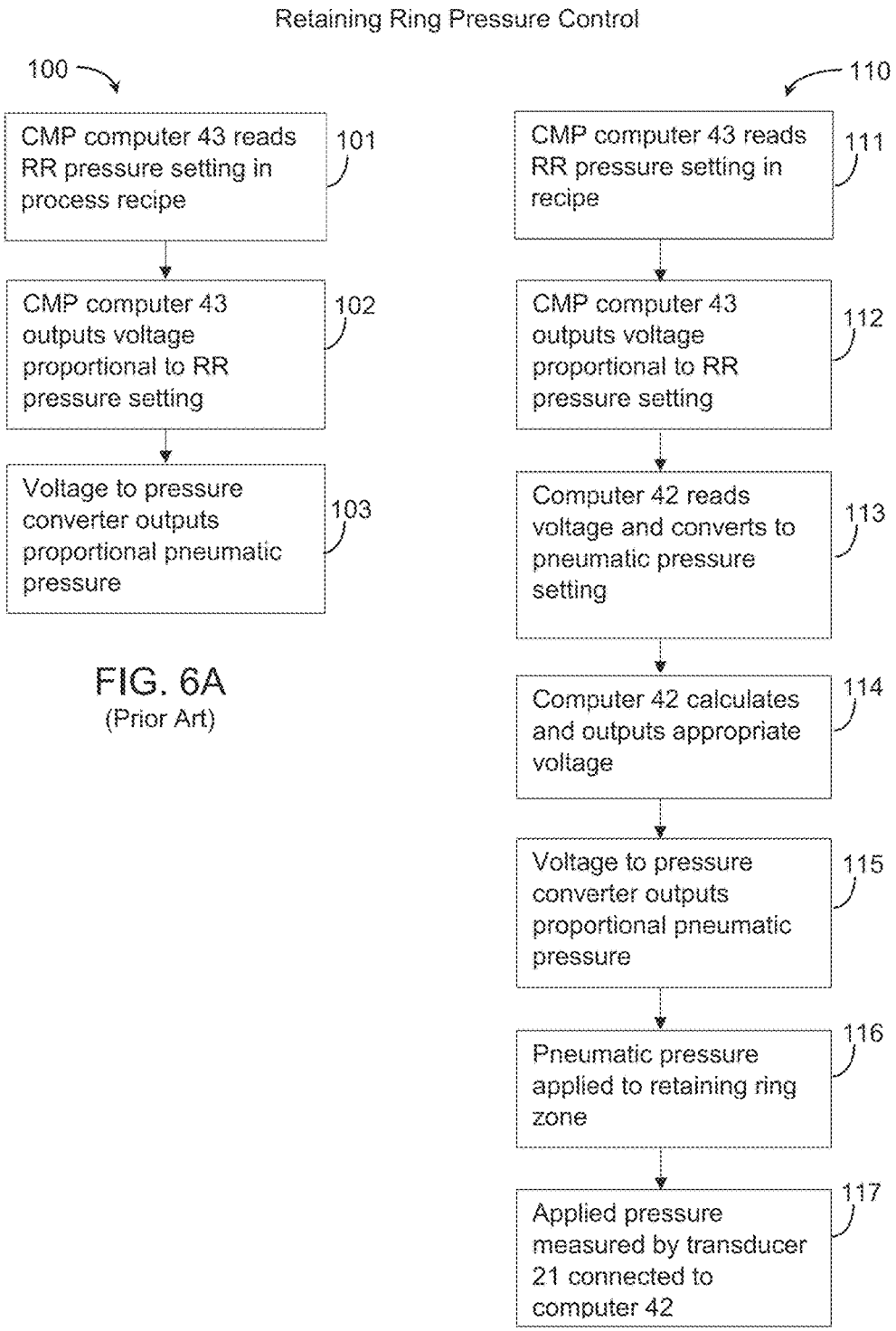
FIG. 6A (Prior Art)
FIG. 6A is a process for controlling retaining ring pressure using a prior art system.
FIG. 6B is a process for retaining ring pressure control using a retrofit CMP carrier system, in accordance with embodiments.

Referring to FIGS. 6A and 6B, embodiments of the system 10 operate for retaining ring pressure control through the retaining ring port 20. As shown in FIG. 6A, operation process 100 of a prior art system includes CMP computer 43 reads retaining ring ("RR") pressure setting in process recipe (Step 101); CMP computer 43 reads outputs voltage proportional to RR pressure setting (Step 102); and voltage to pressure converter outputs proportional pneumatic pressure (Step 103).

In comparison, FIG. 6B depicts and operation process 110 of a system 10 of an embodiment. The process 110 includes CMP computer 43 reads RR pressure setting in process recipe (Step 111); CMP computer 43 outputs voltage proportional to RR pressure setting (Step 112); computer 42 reads voltage and converts to RR pneumatic pressure setting (Step 113); computer 42 calculates and outputs an RR voltage corresponding to the RR pneumatic pressure setting (Step 114); voltage to pressure converter outputs an RR pneumatic pressure proportional to the RR voltage (Step 115); RR pneumatic pressure is applied to retaining ring zone (Step 116); and applied RR pressure is measured by transducer 21 connected to computer 42 (Step 117). The method 110 may further include computer 42 calculates measured RR voltage corresponding to the measured applied RR pressure and outputs to an input assigned to a load cell of an existing CMP machine; and computer 43 interprets the measured RR voltage input as a load cell signal for compatibility with standard software 41.

Example of Setup of a CMP Carrier System

In operation, the CMP carrier system may be retrofitted onto an existing CMP machine 40. Once the CMP carrier 10 and all components are coupled to the existing CMP machine 40 must be calibrated and set up. First, the electropneumatic regulator ("E/P regulator") begins with a CDA Feed Regulator Setup. A user may set/verify the E/P regulator supply air to 25 psi+/−4. This air supplies all three E/P regulators, the MM Regulator 17, IT Regulator 19 and the RR Regulator 21.

The setup of the MM regulator 17 includes:

a. Unplug the MM air line from the electronic regulator manifold block and plug in a pressure gauge.

b. Navigate to MM Manual Control on the CMP computer 43:

c. Set SV-42 to 1 on the CMP computer 43, this energizes the valve.
d. Set SV-44 to 0 on the CMP computer 43, this de-energizes the valve.
e. Set ER-42 to 0 on the CMP computer 43, this applies 0 volts to the EP regulator.
f. Adjust the ZERO potentiometer on the back of the MM regulator until the pressure reads 0.14±0.1 psi on the pressure gauge. This represents the lowest set point the regulators will be able to operate at. The regulators linear responses will be compromised if they are calibrated below this range.
g. Set ER-42 to 10 on the CMP computer 43, this applies 10 volts to the EP regulator.
h. Adjust the SPAN potentiometer on the back of the MM (IT) regulator until the pressure reads 7.25±0.1 psi on the pressure gauge. This represents the highest set point the regulators will be able to operate at. The regulators are capable of operating up to 10 psi, but by setting the upper limit lower, the resolution is maximized.
i. Repeat steps 1.2.6 thru 1.2.9 until values are repeatable, and then set SV-42 back to 0 and reconnect the MM airline.

The setup of the IT regulator 19 includes:

a. Unplug the MM (IT) air line from the electronic regulator manifold block and plug in a pressure gauge.
b. Navigate to MM (IT) Manual Control on the CMP computer 43:
c. Set SV-46 to 1 on the CMP computer 43, this energizes the valve.
d. Set SV-47 to 0 on the CMP computer 43, this de-energizes the valve.
e. Set ER-46 to 0 on the CMP computer 43, this applies 0 volts to the EP regulator.
f. Adjust the ZERO potentiometer on the back of the IT regulator until the pressure reads 0.14±0.1 psi on the pressure gauge. This represents the lowest set point the regulators will be able to operate at. The regulators linear responses will be compromised if they are calibrated below this range.
g. Set ER-46 to 10 on the CMP computer 43, this applies 10 volts to the EP regulator.
h. Adjust the SPAN potentiometer on the back of the IT regulator until the pressure reads 7.25±0.1 psi on the pressure gauge. This represents the highest set point the regulators will be able to operate at. The regulators are capable of operating up to 10 psi, but by setting the upper limit lower, the resolution is maximized.
i. Repeat steps 1.3.6 thru 1.3.9 until values are repeatable, and then set SV-46 back to 0 and reconnect the IT airline.

The setup of the RR electronic regulator 21 includes:

a. Unplug the RR air line from the manifold block and plug in a pressure gauge.
b. Navigate to RR Manual Control on the CMP computer 43:
c. Set SV-48 to 1, this energizes the valve.
d. Set ER-46 to 0, this applies 0 volts to the EP regulator.
e. Adjust the ZERO potentiometer on the RR regulator until the pressure reads 0.72±0.1 psi on the pressure gauge. This represents the lowest set point the regulator will be able to operate at. The regulator's linear response will be compromised if they are calibrated below of this range.
f. Set ER-46 to 10, this applies 10 volts to the EP regulator.
g. Adjust the SPAN potentiometer on the RR regulator until the pressure reads 14.5-15.0 psi on the pressure gauge. This represents the highest set point the regulator will be able to operate at.
h. Repeat steps 1.4.4 thru 1.4.7 until values are repeatable, and then set SV-48 back to 0 and reconnect the RR airline.

After the E/P regulators are set up, the user may perform calibration procedures.

The pressure transducers must be calibrated. Calibrate the pressure transducers using the CMP computer 43 and a pressure/vacuum gauge including:

a. Navigate to the "TX Setup" screen:
b. Select the TX to Calibrate
   i. MM, IT, or RR from the TX Setup screen, followed by "Begin Calibration". Then follow the CMP computer 43 onscreen instructions to complete the semi-automatic calibration of each of the 3 pressure transducers.
c. The actions to perform are displayed on the CMP computer 43.
d. The sequence for calibration is the same for all transducers except the IT does not use vacuum and therefore does not have a vacuum calibration step.
e. After all three transducers are calibrated, navigate to the 'Test Screen' and save the calibration values by pressing the Burn Values button.
   i. If the user fails to 'Burn' the calibration values, the old values will be used when power is cycled.

The E/P regulators may then be calibrated using the CMP computer's 43 automatic calibration. This calibration includes:

a. Navigate to the "Reg. Setup" screen:
   i. Only one regulator can be calibrated at any one time.
b. Press the Calibrate MM button, and wait for it to finish.
c. Press the Calibrate IT button, and wait for it to finish.
d. Press the Calibrate RR button, and wait for it to finish.
e. After all three regulators are calibrated, navigate to the 'Test Screen' and save the calibration values by pressing the Burn Values button.
   i. If the user fails to 'Burn' the calibration values, the old values will be used when power is cycled.

This is an example only for one type of existing CMP machine 40 and similar types of setup may be performed for other types of existing CMP machine 40. The CMP machine 40 with the new CMP carrier 10 and system coupled to it may then be utilized for chemical mechanical planarization.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A retrofit CMP carrier system useful in a CMP process, the system comprising:

an existing CMP machine;

a CMP carrier comprising a resilient flexible membrane upon which a wafer is mounted and at least three air ports, wherein the at least three ports provide pressure to at least the resilient flexible membrane, a de-chuck membrane and a retaining ring, wherein the CMP carrier is retrofitted onto the existing CMP machine;

a CMP computer coupled to the existing CMP machine, wherein the CMP computer contains a software program for operating the existing CMP machine for controlling a down force of the CMP carrier; and a computer operatively coupled between the CMP carrier and the CMP computer, the computer programmed with a software program to:

receive from the CMP computer a signal indicating voltage proportional to a downforce setting determined by the CMP computer operating the software program;

automatically read and covert the voltage signal from the CMP computer to a downforce pneumatic pressure setting; and automatically calculate a downforce voltage corresponding to the downforce pneumatic pressure setting and output the downforce voltage to a voltage to pressure converter, wherein the voltage to pressure converter outputs a downforce pneumatic pressure proportional to the downforce voltage to the flexible membrane of the CMP carrier to apply pressure to a wafer.

2. The system of claim 1, wherein the computer is programmed to receive a signal containing a measured applied pressure by the CMP carrier to the wafer from a transducer connected to the computer.

3. The system of claim 2, wherein the computer is further programmed to automatically calculate a measured downforce voltage corresponding to the measured applied pressure and output the voltage to a load cell of the existing CMP machine.

4. The system of claim 3, wherein the CMP computer operates the standard software to interpret the measured downforce voltage from the load cell signal to operate the software and existing CMP machine.

5. The system of claim 1, wherein the computer is further programmed to receive from the CMP computer a signal indicating voltage proportional to a backpressure setting determined by the CMP computer operating the software program; automatically read and covert the voltage signal from the CMP computer to a backpressure pneumatic pressure setting; and automatically calculate a backpressure voltage corresponding to the backpressure pneumatic pressure setting and output the backpressure voltage to the voltage to pressure converter, wherein the voltage to pressure converter outputs a backpressure pneumatic pressure proportional to the backpressure voltage to the de-chuck membrane of the CMP carrier.

6. The system of claim 5, wherein the computer is programmed to receive a signal containing a measured applied backpressure by the CMP carrier from a transducer connected to the computer and automatically calculate a measured backpressure voltage corresponding to the measured applied backpressure and output the measured backpressure voltage to a load cell of the existing CMP machine to operate the software.

7. The system of claim 1, wherein the computer is further programmed to receive from the CMP computer a signal indicating voltage proportional to a retaining ring pressure setting determined by the CMP computer operating the software program; automatically read and covert the voltage signal from the CMP computer to a retaining ring pneumatic pressure setting; and automatically calculate a retaining ring voltage corresponding to the retaining ring pneumatic pressure setting and output the retaining ring voltage to the voltage to pressure converter, wherein the voltage to pressure converter outputs a retaining ring pneumatic pressure proportional to the retaining ring voltage to the retaining ring of the CMP carrier.

8. The system of claim 7, wherein the computer is programmed to receive a signal containing a measured applied retaining ring pressure by the CMP carrier from a transducer connected to the computer and automatically calculate a measured retaining ring voltage corresponding to the measured applied retaining ring pressure and output the retaining ring voltage to a load cell of the existing CMP machine to operate the software.

9. A retrofit CMP carrier system useful in a CMP process, the system comprising:

an existing CMP machine;

a CMP carrier comprising:

a resilient flexible membrane upon which a wafer is mounted;

a membrane port providing pressure to the resilient flexible membrane;

an inner chamber port providing pressure to a de-chuck membrane; and a retaining ring port providing pressure to a retaining ring, wherein the CMP carrier is retrofitted onto the existing CMP machine;

a CMP computer coupled to the existing CMP machine, wherein the CMP computer contains a software program for operating the existing CMP machine for controlling a down force of the CMP carrier; and a computer operatively coupled between the CMP carrier and the CMP computer and programmed, the computer programmed with a software program to:

receive from the CMP computer a signal indicating voltage proportional to a downforce setting determined by the CMP computer operating the software program;

automatically read and covert the voltage signal from the CMP computer to a downforce pneumatic pressure setting;

automatically calculate and output a downforce voltage corresponding to the downforce pneumatic pressure setting to a voltage to pressure converter;

receive from the CMP computer a signal indicating voltage proportional to a backpressure setting determined by the CMP computer operating the software program;

automatically read and covert the voltage signal from the CMP computer to a backpressure pneumatic pressure setting;

automatically calculate and output a backpressure voltage corresponding to the backpressure pneumatic pressure setting to a voltage to pressure converter;

receive from the CMP computer a signal indicating voltage proportional to a retaining ring pressure setting determined by the CMP computer operating the software program;

automatically read and covert the voltage signal from the CMP computer to a retaining ring pneumatic pressure setting; and automatically calculate and output a retaining ring voltage corresponding to the retaining ring pneumatic pressure setting to a voltage to pressure converter, wherein during operation of the existing CMP machine the voltage to pressure converter outputs:

proportional downforce pneumatic pressure to the flexible membrane of the CMP carrier through the membrane port to apply pressure to a wafer;

proportional backpressure pneumatic pressure to the de-chuck membrane of the CMP carrier through the inner chamber port; and proportional retaining ring pneumatic pressure to the retaining ring of the CMP carrier through the retaining ring port.

10. The system of claim 9, wherein the computer is programmed to receive a signal containing a measured applied pressure by the flexible membrane of the CMP carrier to the wafer from a transducer connected to the computer.

11. The system of claim 10, wherein the computer is further programmed to automatically calculate a measured downforce voltage corresponding to the measured applied pressure and output the measured downforce voltage to a load cell of the existing CMP machine.

12. The system of claim 11, wherein the CMP computer operates the standard software to interpret the measured downforce voltage from the load cell signal to operate the software and existing CMP machine.

13. The system of claim 9, wherein the computer is programmed to receive a signal containing a measured applied pressure by the de-chuck membrane of the CMP carrier from a transducer connected to the computer.

14. The system of claim 13, wherein the computer is further programmed to automatically calculate a measured backpressure voltage corresponding to the measured applied pressure and output the measured backpressure voltage to a load cell of the existing CMP machine.

15. The system of claim 14, wherein the CMP computer operates the standard software to interpret the measured backpressure voltage from the load cell signal to operate the software and existing CMP machine.

16. The system of claim 9, wherein the computer is programmed to receive a signal containing a measured applied pressure by the retaining ring of the CMP carrier to the wafer from a transducer connected to the computer.

17. The system of claim 16, wherein the computer is further programmed to automatically calculate a measured retaining ring voltage corresponding to the measured retaining ring pressure and output the measured retaining ring voltage to a load cell of the existing CMP machine.

18. The system of claim 17, wherein the CMP computer operates the standard software to interpret the measured retaining voltage from the load cell signal to operate the software and existing CMP machine.

* * * * *